United States Patent [19]

DiMarco et al.

[11] Patent Number: 4,541,152

[45] Date of Patent: Sep. 17, 1985

[54] QUICK HOOK-UP AND RELEASE BUCKLING FOR WEIGHT LIFTER BELTS

[76] Inventors: Thomas J. DiMarco, 12815 Pacific Ave., Apt. 7, Los Angeles, Calif. 90066; Joel E. Di Marco, 4288 Revere Pl., Culver City, Calif. 90230

[21] Appl. No.: 558,019

[22] Filed: Dec. 5, 1983

[51] Int. Cl.[4] ..... A44B 11/20

[52] U.S. Cl. ..... 24/271; 24/170; 24/180; 24/191; 24/273

[58] Field of Search ..... 24/270, 271, 273, 170, 24/179, 173, 191, 174, 180, 573, 265 R, 265 BC, 19, 68

[56] References Cited

U.S. PATENT DOCUMENTS

| | | | |
|---|---|---|---|
| 74,243 | 2/1868 | Pond, Jr. et al. | 24/180 |
| 318,053 | 5/1885 | Thurlow | 24/170 |
| 343,727 | 3/1907 | Mulock | 24/265 BC |
| 416,222 | 12/1889 | Harkey et al. | 24/180 |
| 1,223,671 | 4/1917 | Collis | 24/191 |
| 1,502,771 | 7/1924 | Govis | 24/180 |
| 2,065,946 | 12/1936 | Mader | 24/180 |
| 2,579,975 | 12/1951 | Scott et al. | 24/270 |
| 2,864,638 | 12/1958 | Nelson et al. | 24/273 |
| 3,132,392 | 5/1964 | Steinberg | 24/271 |
| 3,633,956 | 1/1972 | Angell | 24/271 |

FOREIGN PATENT DOCUMENTS

| | | | |
|---|---|---|---|
| 650292 | 12/1935 | Fed. Rep. of Germany | 24/180 |

*Primary Examiner*—Victor N. Sakran

*Attorney, Agent, or Firm*—William H. Maxwell

[57] ABSTRACT

A quick hook-up and release toggle and a quickly separable anchor for adjustably interconnecting the anchored live and dead ends of a belt especially suited for constraining the abdominal portion of a weight lifter's torso, and the like, the belt being of substantial width and thickness. The releasable toggle is operable to instantly draw up or allow interconnected separation of the live and dead belt ends, having two operational conditions: a tightened closed condition wherein a link occupies an over-center position drawing the anchors into a predetermined position: and a released interconnected and opened condition wherein the link swings free for complete separation of the live and dead end anchors by manipulation of anchor pins from belt holes, and at least one anchor pin from hooked engagement with the belt.

5 Claims, 10 Drawing Figures

QUICK HOOK-UP AND RELEASE BUCKLING FOR WEIGHT LIFTER BELTS

BACKGROUND

This invention relates to weight lifting and is concerned with the reinforcement of the weight lifter's torso when under great strain. There are many variations of weight lifting wherein bar-bells are lifted, including "Bench Press", "Squat", and "Dead Lift" etc. These body building and "Power Lifting" methods are conducted as contests in order to determine lifting capability of the weight lifter, and it is especially necessary when weight lifting to reinforce the midriff with a belt or band cinched tightly to prevent rupture of the abdominal muscles. For example, the "Squat" method is performed lifting the bar-bells from a shoulder height support, the weight being taken onto the weight lifter's shoulders; the object being to lower into a squat position followed by raising and returning the bar-bells to its initial support at shoulder height. Maximum loads are moved in this manner, putting great strain on the abdominal region which must be reinforced with belly-bands and/or belts designed especially for this purpose. Accordingly, such belts are pre-stressed and must be released from time to time and during any emergency. For example, over exertion by a weight lifter can result in breathing problems, or in the event of faintness, in which case the presence of an extremely tight midriff belt can be devastating, and requiring its immediate release. Therefore, it is a general object of this invention to provide a Quick Hook-Up and Release Buckling For Weight Lifter Belts, and the like, a buckling that reinforces the midriff during lifting and which can be instantly released in case of an emergency.

During the execution of weight lifting, total or all physical energy is applied by the weight lifter and it is the abdominal midriff area of the torso between the rib cage and pelvic girdle which requires containment, as by means of a belly-band or belting. In practice, heavy leather belts or the like are strapped around the midriff and secured by buckles so as to be pulled tight, or cinched, for the application of hoop stress. A wide belt is employed and cinched tightly by a buckle located anteriorly over the abdomen, a common belt width being three to four inches and up to a half inch in thickness. Needless to say, heavy, wide and thick belting can be stiff and uncomfortable at best, since it does not readily yield to changes in contour different than its natural simple curvature, and its natural radius of curvature is greatly limited by its thickness. Accordingly, it is an object of this invention to provide releasable anchor means in a belt buckle of the type under consideration that permits reduced belt thickness. In carrying out this invention, spaced pairs of anchor pins are selectively engaged in equally spaced pairs of bearing holes through the belt, at least one pin being hooked to the belt to prevent separation, the pin and bearing hole diameters being substantial. As a result of the anchor means herein disclosed, the belt thickness is substantially reduced so as to be much more pliable and supple and thereby more readily conformable to abdominal contour variations and/or changes.

The common belt buckle comprised of a ring or rim with a tongue engaged into a hole for fastening the ends of a strap or belt, and the like, is unsatisfactory for the purposes of belts and buckles of the type under consideration, since it is not instantaneously securable. Likewise, hooking devices that have been substituted for buckles are also unsatisfactory since they cannot ensure instant hook-up. For example, weight lifting involves extreme column pressure applied to the spine between the pelvic and pectoral girdles, and it is the abdominal portion of the torso which requires reinforcement in order to maintain an erect posture without collapse. Accordingly, belts of the type under consideration are secured only with great effort, usually requiring several muscular assistants to draw up such a belt and hold it tight while a hook-up or buckle-up is made, prior to a lifting exercise. Therefore, it is an object of this invention to provide for instantaneous hook-up in a weight lifter's belt buckle, or the like, and to this end we employ the toggle joint principle applied to the dead end and live ends of a stiff belt adapted to the contours of the torso of the weight lifter. The toggle principle is comprised of two members pivotally connected to opposite ends of a link, so that the joint tends to straighten into a stopped and aligned condition; an over-center condition that can be instantly applied. It is for this reason that the toggle joint as it is herein disclosed is combined with the aforementioned quick release anchor to the live end of the belt. Accordingly, the present invention involves a buckle permanently anchored to a dead end of the belt, and instantly connectable to the live end of the belt.

The common belt buckle comprised of a ring or rim with a tongue engaged into a hole for fastening the ends of a strap or belt, and the like, is unsatisfactory for the purposes of belts and buckles of the type under consideration, since it is not instantaneously releasable. Likewise, hooking devices that have been substituted for buckles are also unsatisfactory since they cannot ensure instant release. Accordingly, belts of the type under consideration are released only with great effort, usually requiring several muscular assistants to draw up such a belt and hold it tight while release is made, following a lifting exercise. Therefore, it is an object of this invention to provide for instantaneous release in a weight lifter's belt buckle, or the like, and to this end we employ the aforesaid toggle joint principle applied to the dead and live ends of a pliable belt, so that the straightened joint is subject to release and said alignment thereof easily broken; the over-center condition that can be instantly released. A feature is that the toggle action allows separation of the pivotal connections equal to twice the length of the link to which the two said members remain connected, and it is for this reason that the toggle joint as it is herein disclosed is combined with the aforementioned quick release anchor to the live end of the belt. Accordingly, the present invention involves a buckle permanently anchored to a dead end of the belt, and instantly separable from the live end of the belt only after the buckle has been released.

The toggle principle as it is applied by the present invention employs a second class lever that has a link that functions as a prying member between a fulcrum pin that is anchored and a draw pin that pulls the live end of the belt into a tight condition. Since the belt that is to be drawn tight is to a great extent flexible, an unexpected problem arises in the stability of the fulcrum pin that must be anchored to the dead end of the flexible belt. In practice, such an anchor will revolve out of position and thereby create a kink in the dead end portion of the belt. Therefore, it is an object of this invention to provide a stabilizer and extending tongue portion of the belt which together prevent turning of the anchor, and namely a reinforced dead end portion that normally underlies an overlapping live end portion as it is tensioned and pulled tight.

SUMMARY OF THE INVENTION

The quick release anchor and buckle combination of the present invention replaces prior art buckles and the like which are primarily separable in themselves. With the present invention, both the releasable toggle means and releasable anchor means are quickly and/or instantly releasable, the toggle means providing instantaneous interconnected separation, and the releasable anchor means enabling subsequent instantaneous complete separation or disconnection. Accordingly, the toggle means is permanently anchored to the dead end of the belt by a member pivoted to an end of the toggle link, and is releasably anchored to the live end of the belt by a pin and hook-pin member pivoted to the other end of the toggle link. The live end of the belt underlies the dead end thereof, and the releasable toggle means and releasable anchor means combination overlies the lapped ends of the belt, and all of which is contoured to the normal exterior curvature of the weight lifter's abdomen. The buckle and anchor combination is of flat configuration overlying a belt overlap, and is preferably more or less half the width of the belt.

The foregoing and various other objects and features of this invention will be apparent and fully understood from the following detailed description of the typical preferred forms and applications thereof, throughout which description reference is made to the accompanying drawings.

Figure 9:
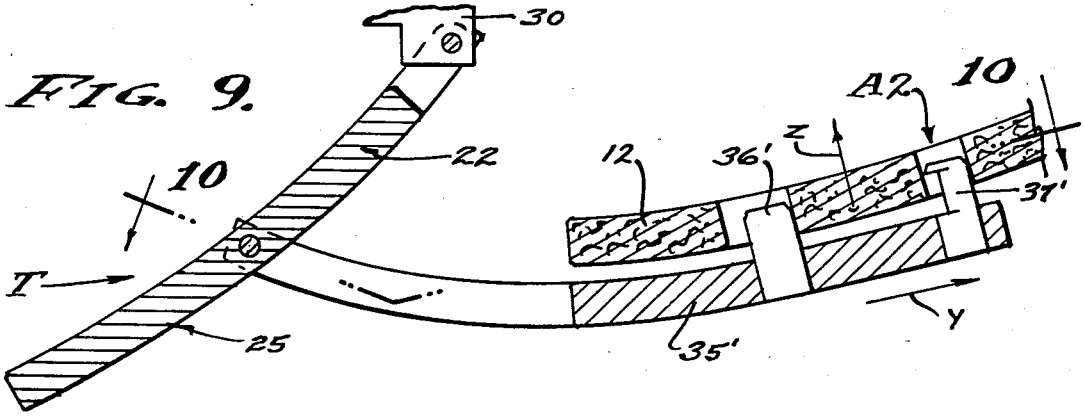
FIG. 9 is a fragmentary view similar to a portion of FIG. 3 showing the second embodiment in the interconnected release condition.
Figure 10:
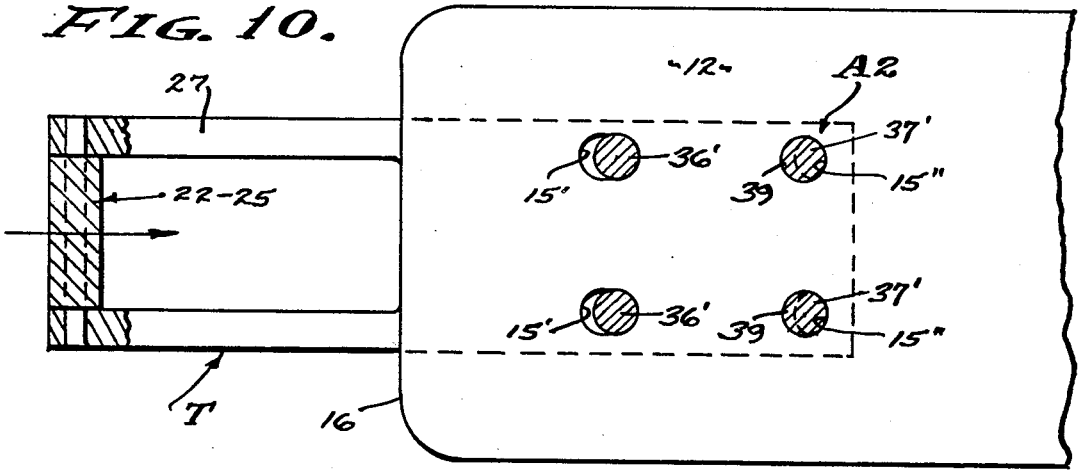

And, FIG. 10 is a sectional view taken as indicated by line 10—10 on FIG. 9.

PREFERRED EMBODIMENT

Referring now to the drawings, this invention involves the combination of a quickly releasable toggle means and a quickly releasable anchor means, for adjustably interconnecting the live and dead ends of a belt used by weight lifters to constrain the abdominal portion of the torso. Accordingly, the Quick Release Buckling of the present invention involves, generally, a constrainment belt B, a releasable toggle means T with a first and permanent anchor means A1, and a second and releasable anchor means A2. The constrainment belt B is a wide flexible member that wraps around the abdomen of the weight lifter, with a substantial overlap. The aforesaid means T, A1 and A2 are combined in an assembly in the nature of members of flattened configuration overlying the belt overlap to releasably interconnect the same.

The belt B is of a substantial width as shown, preferably three or four inches in width as circumstances require. In practice such belts are made of leather strap as much as $\frac{3}{8}''$ thick (or more) in order to adapt to prior art buckle anchors and the like. Thick belting tends to be inflexible, and therefore the belt employed herein is considerably thinner and for example $\frac{1}{4}''$ thick (more or less) which provides the desired flexibility and conformity to abdominal contours and dynamic changes as the weight lifting is performed. The thinner belt is more conformable and wraps around the torso of the weight lifter with an over-under lap of the dead end 11 and live end 12. As shown, the dead end 11 is permanently secured to the anchor means A1 in a position adjusted to the girth of the weight lifter's torso, and to this end the belt B is provided with a series of equally spaced anchor holes 13 along the center median line thereof. The tail portion 14 of the dead end is tapered and extended to underly the live end 12. The live end 12 is releasably secured to the anchor means A2 in a predetermined position at the bitter end portion thereof, and to this end the belt B is provided with two spaced pairs of anchor bearing holes 15 symmetrical with the center median line thereof. The bitter end 16 of the belt B is normal to the parallel side edges 17 thereof, and the inside and outside of the belt are flat and smooth with the bearing holes 13 and 15 opening therethrough.

Figure 4:
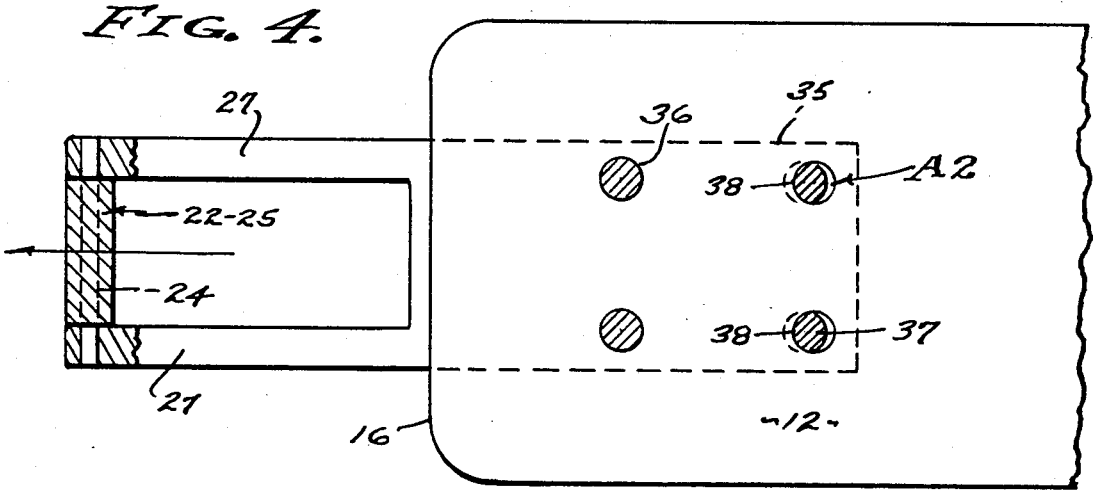
FIG. 4 is a fragmentary view taken as indicated by line 4—4 on FIG. 3.
Figure 5:
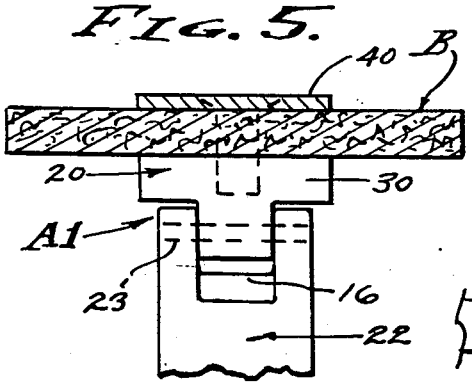
FIG. 5 is a sectional view through the dead end anchor portion of the belt and taken as indicated by line 5—5 on FIG. 3.

The releasable toggle means T is operable to instantly draw up or allow interconnected separation of the belt ends 11 and 12, being anchored to the opposite end portions of the belt as will be described. As shown, the means T is embodied in two anchored members 20 and 21 coupled by a link 22 pivotally connected thereto by pivot pins 23 and 24. The members 20 and 21 and link 22 are flat elongated curvilinear members that follow the exterior contour of the belt end portions that they overlie. For example, these members are $\frac{1}{4}''$ thick aluminum $1\frac{1}{2}''$ (more or less) in width. In carrying out this invention, the toggle member 20 is integral with the anchor means A1, while the toggle member 21 is integral with the anchor means A2, the toggle link 22 being a separate member in the form of a second class lever having a lever arm 25 extension for manual operation. The anchored member 20 has a centered lug 26 with the fulcrum pin 23 extending transversely therethrough and through a bifurcated end portion of the link 22 (see FIG. 5). The anchor member 21 has a bifurcated end portion with extending side legs 27 that embrace the link 22 so that it can lie linearly (or curvilinearly) therebetween and over the anchored member 20, the end portions of the legs 27 having the draw pin 24 extending transversely therethrough and through the center portion of the link 22 and arm 25 lever (see FIG. 4). The link 22 is free to swing through the legs 27 into and out of alignment therewith stopped by engagement of member 20 contiguously with the bottom side of member 21 (see FIG. 2).

Figure 1:
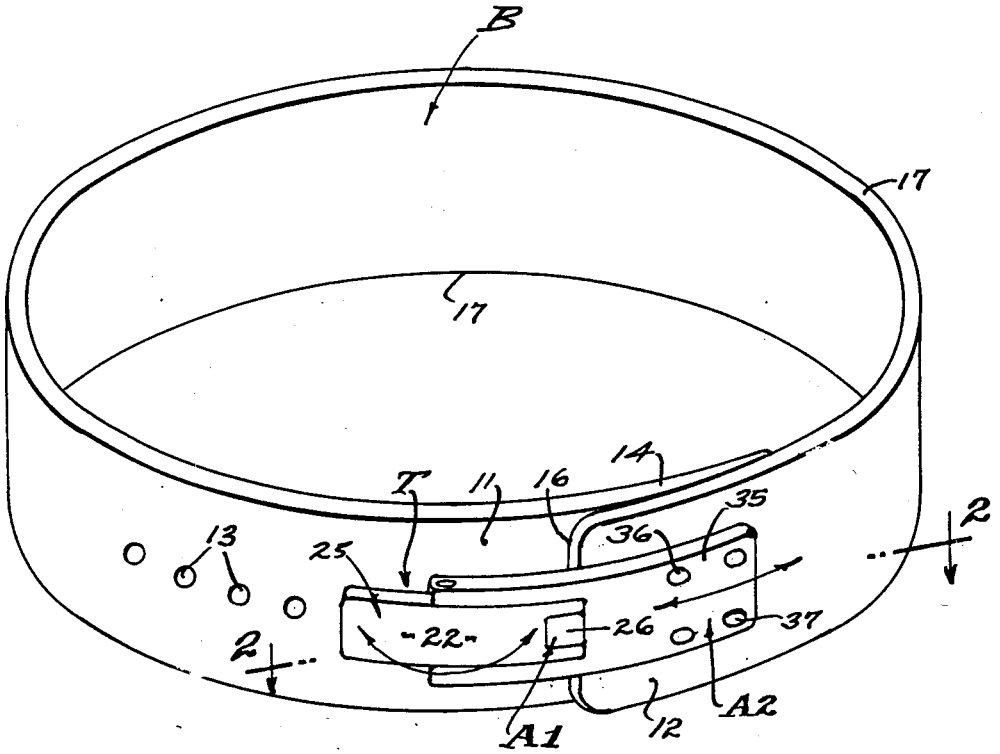
FIG. 1 is a perspective view of a weight lifter's belt drawn into condition by a first embodiment, the Quick Hook-up and Release Buckling of the present invention, and shown as it would appear embracing the torso.
Figure 2:
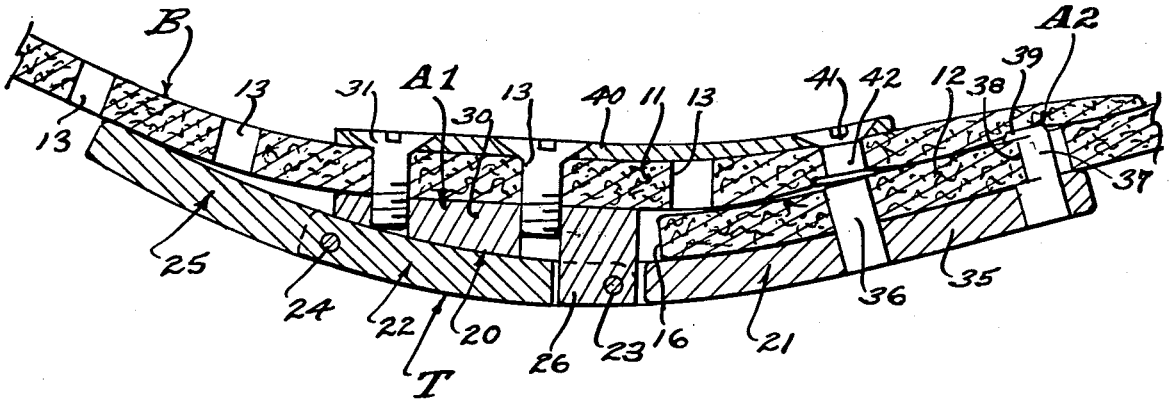
FIG. 2 is an enlarged detailed sectional view taken as indicated by line 2—2 on FIG. 1, showing the tightened condition.
Figure 3:
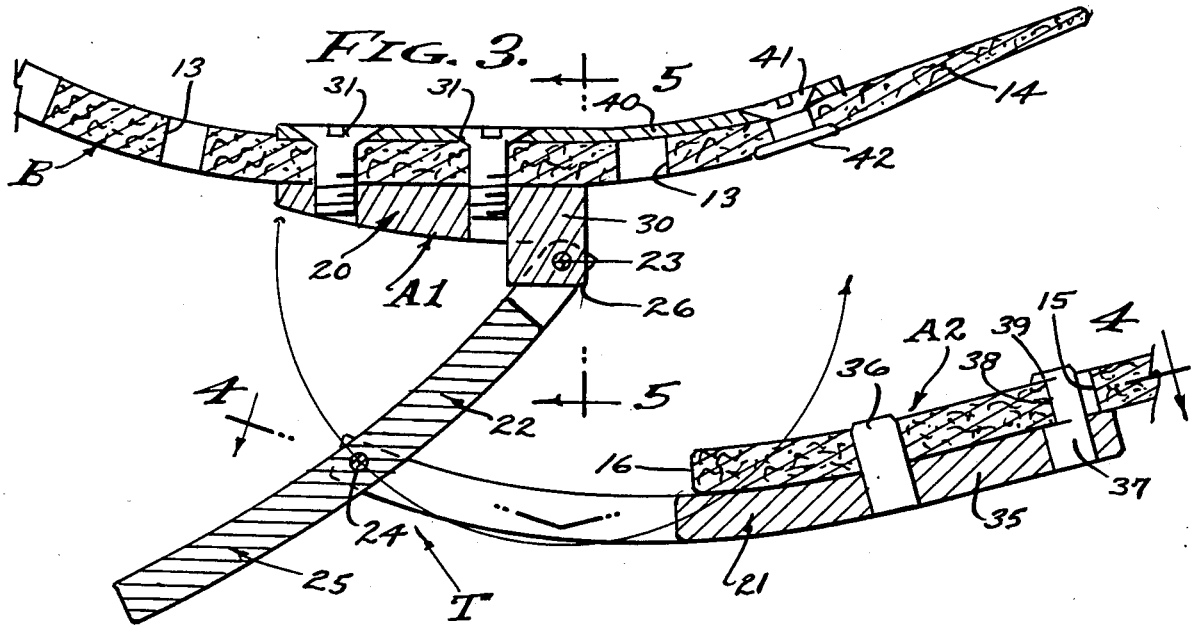
FIG. 3 is a view similar to FIG. 2 showing a partially released interconnected condition of the buckling.

The above described releasable toggle means T has two operational conditions; a closed over center condition shown in FIG. 2 wherein the link 22 occupies the space between the embracing legs 27 in which case the anchor means A1 and A2 are drawn into a predetermined tightened position toward each other; and an interconnected opening condition shown in FIG. 3 wherein the link 22 swings free to extend from the legs 27 by means of the draw pin 24 in which case the anchor means A1 and A2 can separate the pivot pins 23 and 24 twice the length of link 22 (length between pins 23 and 24). The arm 25 swings freely through the bifurcation of member 21.

The permanent anchor means A1 for the fulcrum pin 23 is integral with the toggle member 20 and comprises an elongate base 30 that is adjustably secured to the dead end 11 of the belt B. As shown, the base 30 carries the lug 26 so that it projects centrally into the bifurcation of link 22, the base 30 being a rectangular member of a thickness ($\frac{1}{4}$") comparable to the thickness of the bitter end 16 of belt B and of a width up to but not exceeding the width ($\frac{1}{2}$") of toggle member 21. Thus, the top face of base 30 presents a stop for the toggle member 21 (see FIG. 2). Securement of base 30 to the outer face of the belt end portion 11 is in an adjusted position by means of screw fasteners 31 or the like engaged through the spaced anchor holes 13 and threaded into registering threaded openings in the base. Thus, the base 30 has flat interface engagement with the belt and can be adjusted for example to one inch spaced increments of the holes 13 as may be required.

In accordance with this invention, the anchor A1 is stabilized by a reinforced extension of the dead end portion 11 of belt B overlapping the live end portion 12. As shown, a substantial portion of tongue 14 is stabilized by a reinforcing plate 40 fixedly secured to toggle member 20 by the screw fasteners 31. The plate 40 is a stiff member formed to the curvature over the abdomen and is also secured to the remote end of tongue 14 by means of a screw fastener 41 and nut 42 as indicated. Thus, regardless of any flexibility in the belt, the tongue 14 becomes a stiffened member fixedly secured to the toggle member 20 so as to permit displacement thereof when leverage is applied to link 22 in drawing the anchor A2 into a tightened condition. In practice, the plate 40 can be positioned between the belt B and base 30, or over the belt B as a backing. As shown, the plate 40 is applied as a backing reinforcement and to accomodate heads of fasteners 31, eliminating the necessity of washers of such a plate bearing upon the belt.

The releasable anchor means A2 for the draw pin 24 is integral with the toggle member 21 and comprises a plate 35 to overlie the live end portion 12 of the belt B. As shown, the plate 35 is a continuation of the toggle member 21 and has a portion complementary to and overlying the terminal end portion of the belt B comprising the live end 12; the live end of the belt B being that end which comes free of the buckle when the toggle is released. Securement of plate 35 to the outer face of the belt B end portion 12 in a releasable position is by means of two longitudinally spaced pins engageable in the aforesaid spaced anchor bearing holes 15.

Figure 6:
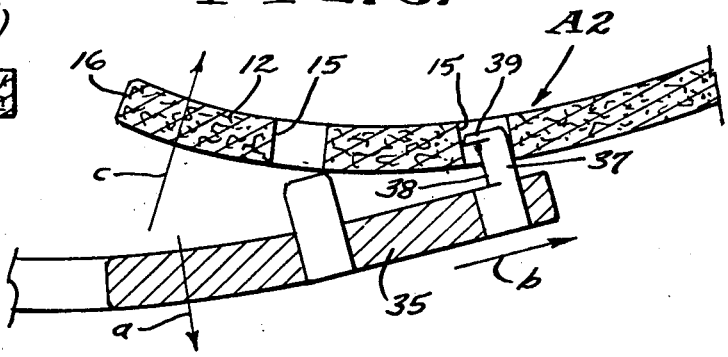
FIG. 6 is a fragmentary view of a portion of FIG. 3 showing the complete separation of the live end anchor portion of the belt.
Figure 7:
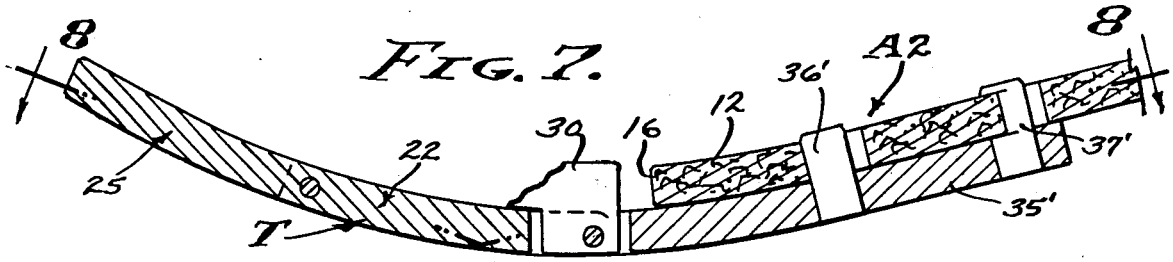
FIG. 7 is a fragmentary view similar to FIG. 2 showing a second embodiment of the Quick Hook-Up and Release Buckling in the tightened condition.
Figure 8:
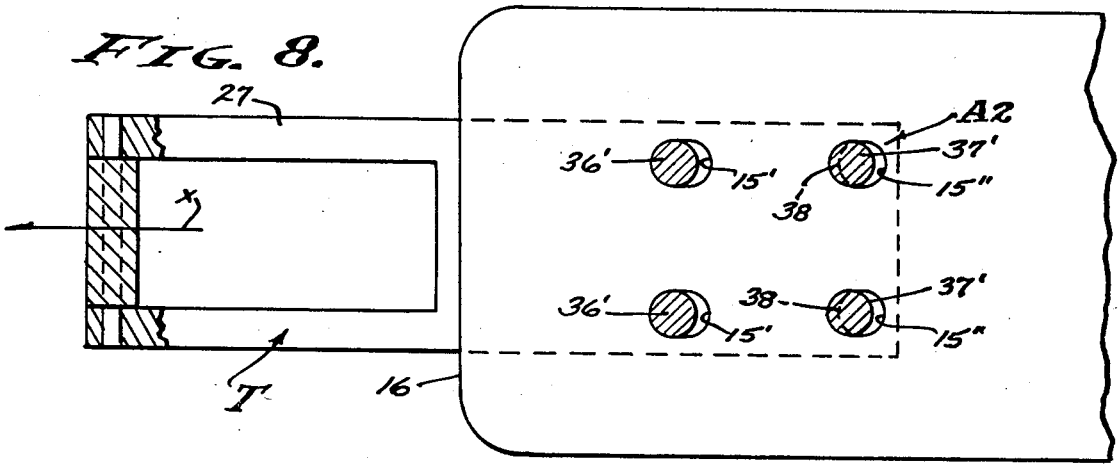
FIG. 8 is a sectional view taken substantially as indicated by line 8—8 on FIG. 7.

In the first form of the invention as it is illustrated in FIGS. 1 through 6 securement of plate 35 is by means of two longitudinally spaced pairs of pins 36 and 37 engageable in the aforesaid two spaced pairs of full diameter bearing holes 15. The plate 35 is flat and the pairs of pins 36 and 37 are on spaced parallel axes disposed normal to the plate. The pair of pins 36 spaced farthest from the end of plate 35 are straight full diameter pins. The pair of pins 37 nearest the end plate 35 are hooked pins, each having a head the full diameter of holes 15 to pass therethrough and having a reduced half diameter 38 on the side of the pins facing the pivoted link 22. This offset diameter arrangement provides an inner face on the head 39 that faces the plate 35 to form a hook to engage the inner side of the belt. Thus, when the toggle means is tightened the reduced half diameter of the pins 37 bear in their respective full diameter bearing holes 15 while the full diameter of pins 36 also bear in their respective full diameter bearing holes 15. This hooked engagement ensures that the plate 35 cannot revolve to release the live end portion of the belt B. However, when the toggle means T is released there is slack movement which permits instant release of the hooked pin and belt engagement, as shown in FIG. 6, for complete and instantaneous separation of the belt from the buckle, whereby the live end 12 of the belt B becomes free.

The releasable anchor A2 of the first form thus far described operates as follows when the belt B is somewhat flexible: In the set condition of FIGS. 1 through 4, the pair of anchor pins 37 is drawn toward the end 16 of the belt so that the half diameters 38 bear against one side of the full diameter anchor bearing holes 15 with the heads 39 of hool formation overlying the inside of the belt to capture the same; and in this position the other pair of anchor pins 36 align with an engage into a pair of full diameter anchor bearing holes 15, thereby securing the anchor A2. In order to release anchor A2, it is simply necessary to lift the plate 35 from the dead end portion of the belt in the direction of arrow a in FIG. 6 so as to permit shifting of the plate 35 in the direction of arrow b in FIG. 6, thereby aligning the heads 39 with the holes 15 for withdrawal and complete removal of the anchor A2 from the live end of the belt. Simultaneously, the terminal end 16 of the belt can be separated and held away from the plate 35 in the direction of arrow c in FIG. 6. The movements a, b and c are applied by manipulation in the directions indicated.

In the second form of this invention as it is illustrated in FIGS. 7 through 10, securement of anchor A2 and of plate 35' is by means of two longitudinally spaced pairs of pins 36' and 37' engageable in two spaced pairs of bearing holes 15' and 15". The plate 35' is flat and the pairs of pins 36' and 37' are on spaced parallel axes disposed normal to the plate, and positioned and of the same configuration as pins 36 and 37 hereinabove described. However, in this form of the invention it is contemplated that the belt B is relatively stiff and difficult to flex or bend, and in which case the bearing holes 15' for the anchor pins 36' are slotted by elongation in a direction toward the anchor pins 37', as clearly shown in FIG. 7 of the drawings, where the hooked pin 37' engages against the side of bearing hole 15". Thus, when the toggle means is tightened and indicated by arrow x, the reduced half diameters of pins 37' bear against one side of their respective full diameter bearing holes 15", while a half diameter of the full diameter pins 36' bear against the one outer end of the slotted bearing holes 15'. The hooked engagement is the same as disclosed in the first form of the invention.

The releasable anchor A2 of the second form of the invention, last described, operates as follows when the belt B is relatively stiff and inflexible: The set condition of this second form is essentially the same as with the first form, excpet that the pins 36' are engaged with the outer ends or sides of the slotted bearing openings 15'. However, in order to release anchor A2, it is simply necessary to shift the plate 35' in the direction of arrow y in FIG. 10, so that the plate 35' can be lifted away from the end portion 12 of belt B in the direction of arrow z in FIG. 9. It will be seen, as with operation of the first form of the invention, the toggle means T is first released so that there is interconnected released conditions of the anchors A1 and A2, whereby the anchors A1 and A2 are loosened and easily separated.

Having described only the typical preferred forms and applications of our invention, we do not wish to be limited or restricted to the specific details herein set forth, but wish to reserve to ourselves any modifications or variations that may appear to those skilled in the art as set forth within the limits of the following claims.

We claim:

1. A quick hook-up and release buckling for belts of substantial width and thickness having opposite dead end and live end portions and having a tightened closed condition and an interconnected released condition for subsequent complete separation of one or two anchor means, and including;

a releasable toggle means comprised of a first anchor means permanently secured to the dead end portion of the belt, a second anchor means comprised of a plate to overlie and releasably secured to the live end portion of the belt in the closed and in the interconnected released condition, and a link pivoted to the first anchor means by a fulcrum pin and to an extension of the second anchor member by a draw pin spaced from the live end of the belt, the extension lying contiguous over the first anchor means when the toggle means is in a closed over-center condition drawing the second anchor means into a tightened closed condition, the live end portion of the belt having two longitudinally spaced bearing holes, and the plate having two longitudinally spaced pins engageable through said spaced bearing holes for bearing engagement against the sides thereof toward an end portion of said belt, one pin having an offset half diameter to bear in its hole and a full diameter head hooked through the live end portion of the belt, and the link swinging free when released from said closed over-center condition for interconnected separation of the first and second anchor means and for subsequent complete separation of the second anchor means from the live end portion of the belt by shifting of the plate and alignment of the full diameter head of the one pin with its bearing hole for withdrawal and complete separation from the belt.

2. The quick hook-up and release buckling for belts as set forth in claim 1, wherein one pin of the second anchor means comprised of the plate and longitudinally spaced pins has full slideable bearing engagement through its bearing hole in the belt for release by lifting the plate and said one pin from its bearing hole to permit shifting of the plate and alignment of the full diameter head of the other pin with its bearing hole for withdrawal and complete separation from the belt.

3. The quick hook-up and release buckling for belts as set forth in claim 2, wherein the plate of the second anchor means has two longitudinally spaced pairs of pins engageable in two longitudinally spaced pairs of bearing holes in the belt.

4. The quick hook-up and release buckling for belts as set forth in claim 1, wherein one pin of the second anchor means comprised of the plate and longitudinally spaced pins has sliding bearing engagement through an elongated bearing hole in the belt for release by shifting the plate and said one pin in the elongated bearing hole to align the full diameter head of the other pin with its full diameter bearing hole for withdrawal and complete separation from the belt.

5. The quick hook-up and release buckling for belts as set forth in claim 4, wherein the plate of the second anchor means has two longitudinally spaced pairs of pins engageable in two longitudinally spaced pairs of bearing holes in the belt.

* * * * *